US012655699B2

(12) United States Patent
Kennedy

(10) Patent No.: US 12,655,699 B2
(45) Date of Patent: Jun. 16, 2026

(54) DISSOLVABLE LOCK

(71) Applicant: Shale Oil Tools, LLC, Rosenberg, TX (US)

(72) Inventor: Brian Kennedy, Sugar Land, TX (US)

(73) Assignee: Shale Oil Tools, LLC, Rosenberg, TX (US)

( * ) Notice: Subject to any disclaimer, the term of this patent is extended or adjusted under 35 U.S.C. 154(b) by 0 days.

(21) Appl. No.: 18/922,148

(22) Filed: Oct. 21, 2024

(65) Prior Publication Data

US 2026/0110228 A1 Apr. 23, 2026

(51) Int. Cl.
*E21B 23/01* (2006.01)
*E21B 29/02* (2006.01)
*E21B 43/12* (2006.01)

(52) U.S. Cl.
CPC ..... *E21B 23/01* (2013.01); *E21B 29/02* (2013.01); *E21B 43/128* (2013.01)

(58) Field of Classification Search
CPC ..... E21B 23/01; E21B 29/02; E21B 2200/08; E21B 23/00
See application file for complete search history.

(56) References Cited

U.S. PATENT DOCUMENTS

| | | | | |
|---|---|---|---|---|
| 10,400,535 | B1 * | 9/2019 | Greenlee | E21B 33/128 |
| 2011/0198082 | A1 * | 8/2011 | Stromquist | E21B 43/114 166/66 |
| 2012/0090847 | A1 * | 4/2012 | Getzlaf | E21B 34/10 166/305.1 |
| 2018/0038191 | A1 * | 2/2018 | Davies | C08K 3/346 |
| 2018/0179851 | A1 * | 6/2018 | Davies | E21B 23/01 |
| 2020/0018135 | A1 * | 1/2020 | Zeng | E21B 33/134 |
| 2020/0277831 | A1 * | 9/2020 | Kellner | E21B 33/1293 |
| 2021/0270099 | A1 * | 9/2021 | Mhaskar | E21B 33/1291 |

* cited by examiner

*Primary Examiner* — David Carroll
(74) *Attorney, Agent, or Firm* — Ramey LLP

(57) ABSTRACT

The current invention describes a plug that may be run into a well for example an electric submersible pump without the plug locking into the wellbore casing or setting. The plug may then be allowed to sit within the well for a predetermined period of time during which a dissolvable lock is removed from the plug. With the dissolvable lock removed further downward travel is prevented by the plug locking into place while the electrical submersible pump may be freely retrieved to the surface.

12 Claims, 8 Drawing Sheets

DISSOLVABLE LOCK

BACKGROUND

Generally, after a well is drilled. Formation pressure within the reservoir is sufficient to push the fluids within the formation to the surface. However, as the fluid within the reservoir is pushed to the surface the pressure within the reservoir decreases, eventually the weight of the column of fluid from within the reservoir exerts enough force back to the formation that the formation pressure is no longer sufficient to produce fluids to the surface.

At some point, usually prior to the complete cessation of producing fluids to the surface, the well operator may decide to incorporate artificial lift in order to provide additional assistance to move the fluids from the reservoir to the surface. One type of artificial lift is an electric submersible pump.

When in use an electric submersible pump may last anywhere between three and 12 months. Which means that on occasion the electric submersible pump will need to be retrieved from the wellbore. Unfortunately, due to the corrosive environment, electric submersible pumps tend to separate during retrieval. Therefore at least one and usually more than one fishing trip is required to remove an electric submersible pump from the well bore. In many instances when attempting to retrieve the electric submersible pump the fishing equipment will push the electric submersible pump deeper into the wellbore and into the curved sections of horizontal wells making electric submersible pump difficult to extract from the wellbore.

SUMMARY

In an embodiment of the present invention, a plug is attached to the bottom of an electric submersible pump. The plug is comprised of slips that are set by a cone pressing downward from above onto an inner surface, a ramp, of the slips. As the cone presses down on the ramp the slips are pushed outward and into the wellbore casing locking the plug into position. However, in order to prevent the slips from prematurely setting and locking the plug into position, a dissolvable lock is provided between the cone and the ramp. As pressure is applied to the cone, the force is transferred through the dissolvable lock, to the slips pushing the slips ahead of the cone as the cone moves without allowing the cone to reach the ramp and set lock the plug in place.

In an embodiment of the present invention a plug having a cone is coupled to slips that are coupled to drag blocks may be lowered or pushed into a well. However, a dissolvable lock prevents the slips from moving upward on the cone thereby allowing the plug to be lowered or pushed into the well without setting. Once sufficient time has passed the dissolvable lock dissolves or erodes away and no longer prevents the slips from moving upward on the cone so that additional downward pressure on the cone allows the cone to contact the inner surface of the slips forcing the slips radially outward and into contact with the casing or formation, thereby locking the plug into place within the casing or formation. When it becomes necessary to remove the plug, upward force is applied to the plug cone removing the cone from the slips inner surface thereby releasing the plug from the casing or formation.

In some instances the plug may be attached to the bottom of an electric submersible pump and is then lowered into the well with the electric submersible pump. When the electric submersible pump is in position, and therefore the plug is in position the dissolvable lock is allowed to dissolve or degrade over time so that by the time the electric submersible pump fails or otherwise is removed from the well, the plug is prepared to be set. If needed, when removing the electric submersible pump, pushing downward on the electric submersible pump, such as when attaching a fishing tool, will cause the previously unset plug to set, allowing the fishing tool to engage the electric submersible pump. When the fishing tool applies upwards pressure to the electric submersible pump and thus the plug, the plug releases the slips allowing both the plug and the electric submersible pump to be retrieved to either a second location within the well or to the surface.

In an alternative embodiment, the plug may include a J lock system such that after the dissolvable lock is removed the plug will have to go through at least one pull up, push down cycle prior to reaching a condition where the plug may be set.

DETAILED DESCRIPTION

The description that follows includes exemplary apparatus, methods, techniques, or instruction sequences that embody techniques of the inventive subject matter. However, it is understood that the described embodiments may be practiced without these specific details.

Figure 1:
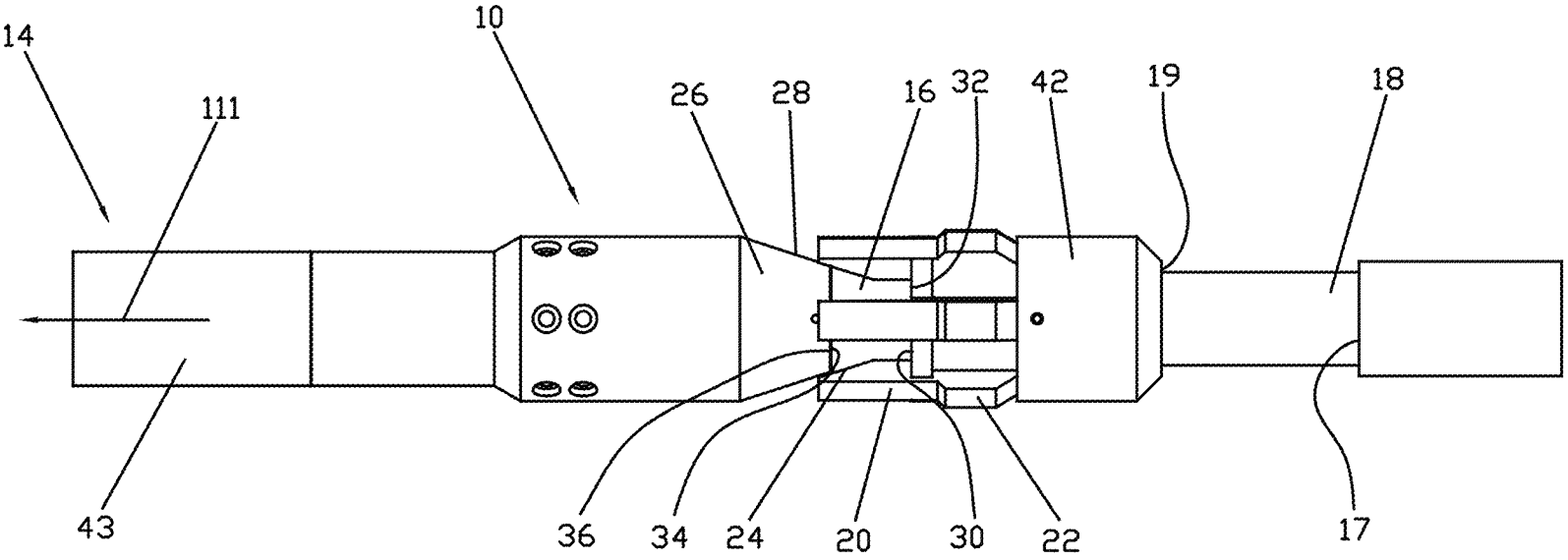
FIG. 1 is a cross-section of a plug having a dissolvable lock in the plug's run-in configuration.

FIG. 1 is a side view of a plug in a state ready to be run into a well, either by itself or attached to another tool. The dissolvable plug 10 includes a lower end 12 and an upper end 14. The plug includes a mandrel 18. Arranged about the mandrel 18 on the lower end of the plug 10 is a set of slips 20. The slips 20 have an extended portion that function as drag blocks 22. The slips 20 also include an angled inner surface 24 that are arranged to interact with a cone 26. The cone 26 has an angled outer surface 28 arranged to interact with the cones angled inner surface 24. Arranged between the cone 26 and the slips 20 is a dissolvable lock 16. The dissolvable lock 16 may be constructed of a dissolvable metal such as dissolvable aluminum or dissolvable magnesium. In FIG. 1 the dissolvable lock 16 is circumferential about the mandrel 18 and has a first shoulder 30 that is arranged to contact the slips' first shoulder 32 and a second shoulder 34 that is arranged to contact the cone's first shoulder 36. The dissolvable lock 16 transmits axial force applied to the cone 26 to the slips 20 and prevents the cone 26 angled outer surface 28 from contacting the slips 20 angled inner surface 24 for so long as the dissolvable lock remains in place, prior to the dissolvable lock's removal.

Figure 2:
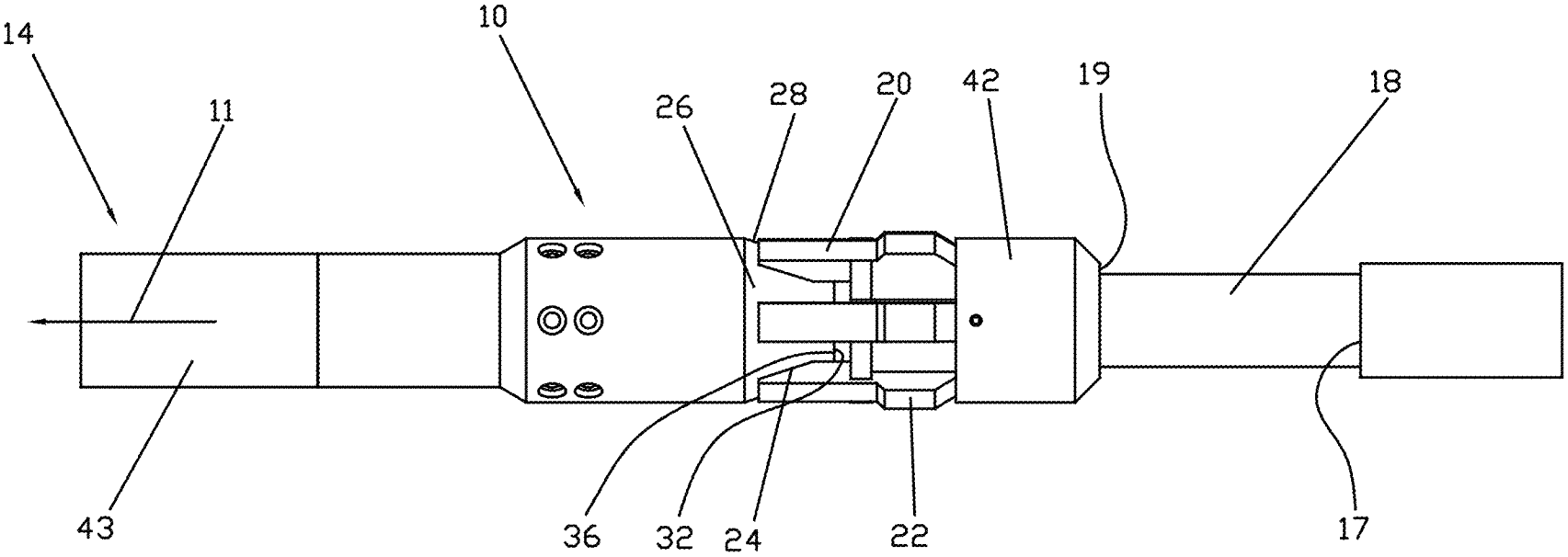
FIG. 2 is a cross-section of a plug having a dissolvable lock in the plug's ready to set configuration.

FIG. 2 shows the dissolvable plug 10 from FIG. 1 with the dissolvable lock 16 absent. With the dissolvable lock 16 absent, drag blocks 22 are able to provide sufficient resistance to further downward movement of the slips 20, drag block 22, and shroud 42 assembly allowing the mandrel 18 to move within the slips 20, drag block 22, and shroud 42 assembly causing the cone 26 angled outer surface 28 may contact the slips' 20 angled inner surface 24.

Figure 3:
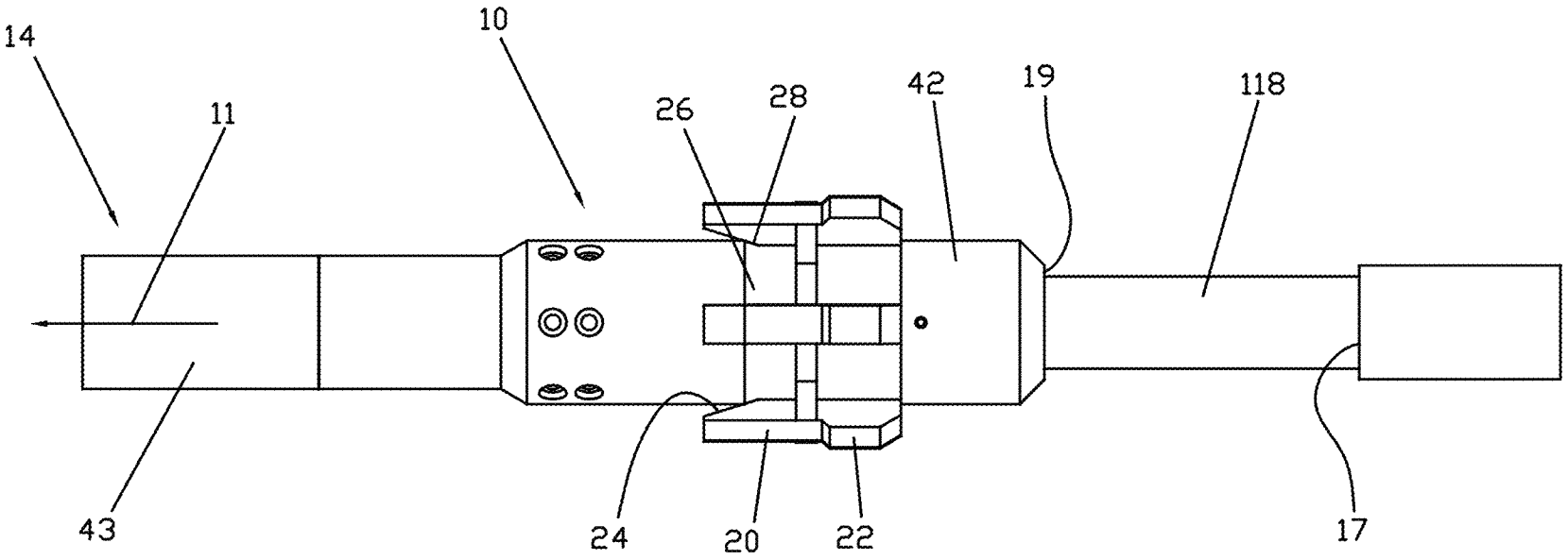
FIG. 3 is a cross-section of a plug having a dissolvable lock in the plug's set configuration.

FIG. 3 shows the dissolvable plug from FIG. 2 after the slips 20 are fully extended. In order to fully extend the slips 20, the drag blocks 22 continue to resist the downward movement due to friction between the drag blocks 22 and the well bore wall or casing. The friction provides sufficient force provided that the dissolvable lock 16 is absent such that the slips 20, the drag blocks 22, and shroud 42 assembly continues to move on the mandrel 18. As the slips 20 move on the mandrel 18, eventually the slips 20 angled inner surface 24 contacts the cone's 26 outer angled surface 28. As the slips 20 continue upward on the cone 26 the slips 20 angled inner surface 24 and the cone 26 is outer angled surface 28 act together to force the slips radially outward. As the slips move further outward the drag blocks 22 are pressed further into the well bore wall or casing eventually reaching a point where the slips 20 are no longer able to move radially outward thereby locking the dissolvable plug 10 in place within the wellbore.

Figure 4:
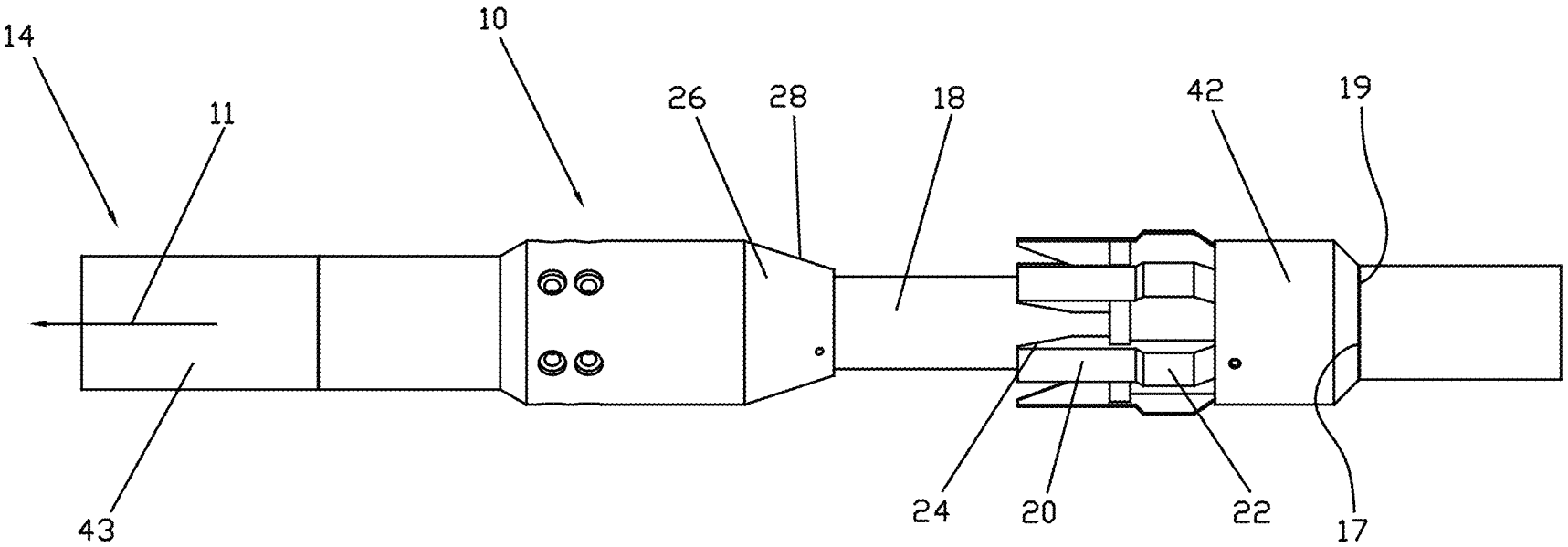
FIG. 4 is a cross-section of a plug having a dissolvable lock in the plug's remove from the well configuration.

FIG. 4 shows the dissolvable plug from FIG. 3 in a condition to allow the dissolvable plug's 10 removal from the wellbore. An axial force is provided in the direction of arrow 11 on the upper end 14 of the dissolvable plug 10. The axial force in the direction of arrow 11 causes mandrel 18 as well as cone 26, which is rigidly attached to mandrel 18, to move in the upwards direction. Drag blocks 22 and slips 20 are locked within the wellbore and are thereby prevented from moving in the upwards direction with mandrel 18. As cone 26 is removed from supporting slips 20, the slips 20 and drag blocks 22 may now move radially inward. As the slips 20 and drag blocks 22 move radially inward they become detached from the wellbore or casing and no longer hold the dissolvable plug 10 in position within the wellbore or casing. As mandrel 18 continues to move upwards eventually mandrel shoulder 17 contacts shroud shoulder 19 preventing further downward movement of the shroud 42, drag blocks 22, and slips 20. As the axial force in the direction of arrow 11 continues, the entire dissolvable plug 10 and its various components may be removed from the well bore or casing.

Figure 5:
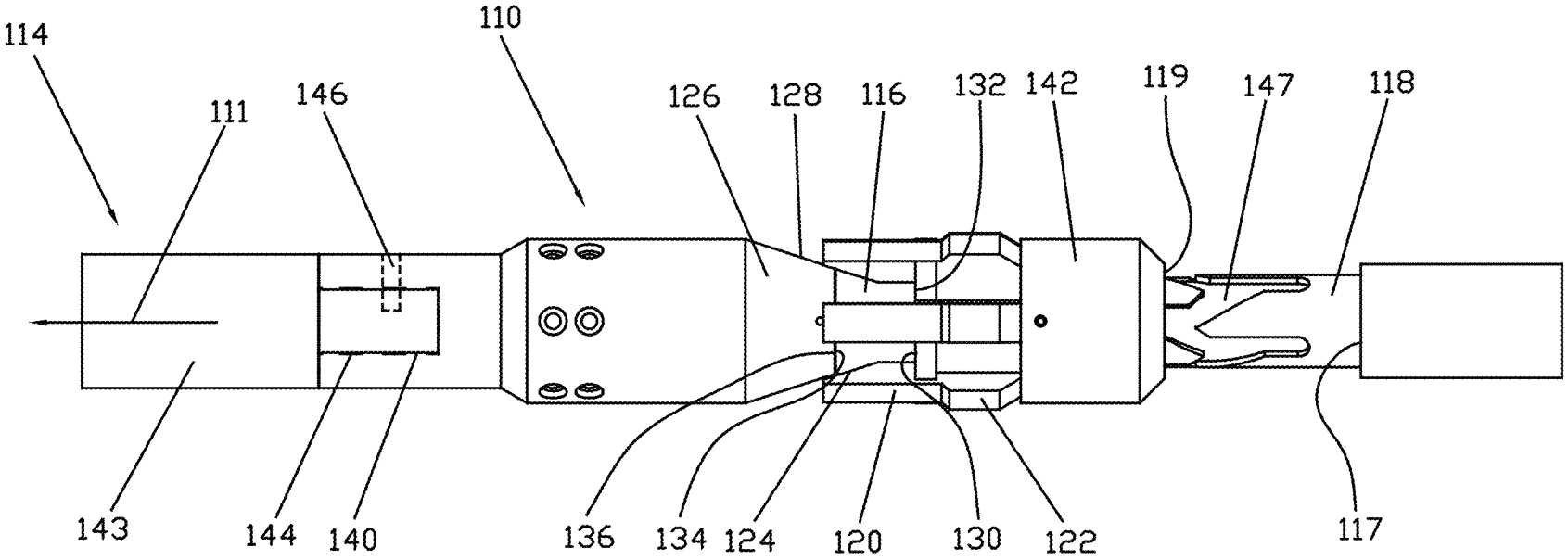
FIG. 5 depicts a side view of an alternative embodiment of a dissolvable plug ready to be run into a well.

FIG. 5 depicts a side view of an alternative embodiment of a dissolvable plug ready to be run into a well, either by itself or attached to another tool. The plug 110 includes a lower end 112 and an upper end 114. The plug includes a mandrel 118. The mandrel 118 includes a j-track 147. Arranged about the lower end of the slips 120 is a shroud 142. The shroud 142 includes at least one pin that cooperates with the j-track 147. Arranged about the mandrel 118 on the lower end of the dissolvable plug 110 is a set of slips 120. The slips 120 have an extended portion that function as drag blocks 122. The slips 120 also include an angled inner surface 124 that are arranged to interact with a cone 126. The cone 126 has an angled outer surface 128 arranged to interact with the cones angled inner surface 24. Arranged between the cone 126 and the slips 120 is a dissolvable lock 116. The dissolvable lock 116 may be a bar affixed to the mandrel 118 and has a first shoulder 130 that is arranged to contact the slips' first shoulder 132 and a second shoulder 134 that is arranged to contact the cone's first shoulder 136. The dissolvable lock 116 transmits axial force applied to the cone 126 to the slips 120 and prevents the cone 126 angled outer surface 128 from contacting the slips 120 angled inner surface 124 for so long as the dissolvable lock 116 remains in place, prior to the dissolvable lock's removal. Once the dissolvable lock 116 is removed the shroud 142 and at least one pin, usually on an inner surface of shroud 142, cooperates with the j-track 147 to provide an additional lock to prevent the cone 126 angled outer surface 128 from contacting the slips 120 angled inner surface 124 until the tool, or other equipment above the plug is cycled sufficient times to allow the shroud's pin to pass through the j-track 147 to the point where the j-track 147 and shroud 142 allow cone 126 angled outer surface 128 to contact the slips 120 angled inner surface 124 thereby allowing the mandrel 118 to move within the slips 120, the drag blocks 122, and the shroud 142. On the upper end of dissolvable plug 110 is recess 140. Recess 140 is provided such that the tool, or other equipment 142 above the plug 110 may be provided with a protrusion 144. Protrusion 144 is inserted into recess 140. Shear devices 146, such as a shear pin, fix the protrusion 144 within recess 140. In the event that the dissolvable plug 110 becomes lodged within the well, an upward force may then be applied to shear the shear device 146 thereby allowing the tool or other equipment 143 to be separated from the dissolvable plug 110 and removed from the well.

Figure 6:
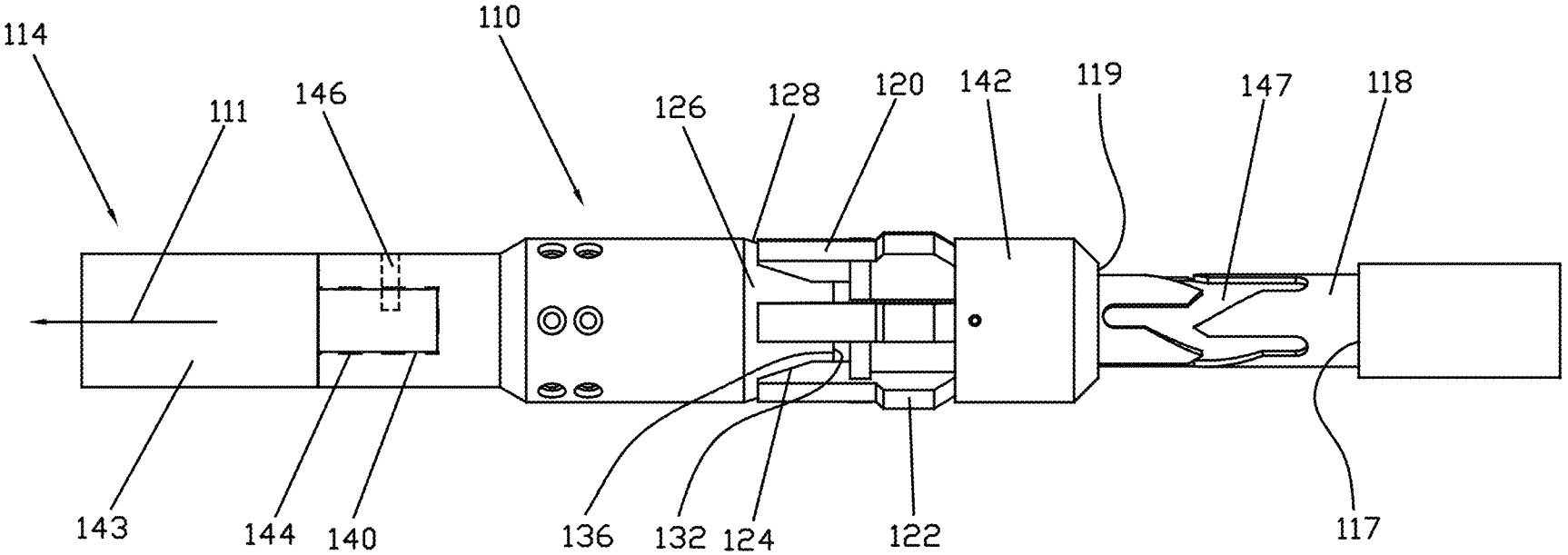
FIG. 6 is a side view of the dissolvable plug from FIG. 5 with the dissolvable lock absent and shroud's pin cycled through the j-track.

FIG. 6 shows the dissolvable plug 110 from FIG. 5 with the dissolvable lock 116 absent and shroud's 142 pin cycled through the j-track allowing the mandrel 118 to move within the slip 120, drag block 122, and shroud 142 assembly. With the mandrel relatively free, drag blocks 122 are able to provide sufficient resistance to further downward movement of the slips 120, drag block 122, and shroud 142 assembly. The mandrel 118 is then able to move within the slips 120, drag block 122, and shroud 142 assembly such that the cone 126 angled outer surface 128 may contact the slips' 120 angled inner surface 124.

Figure 7:
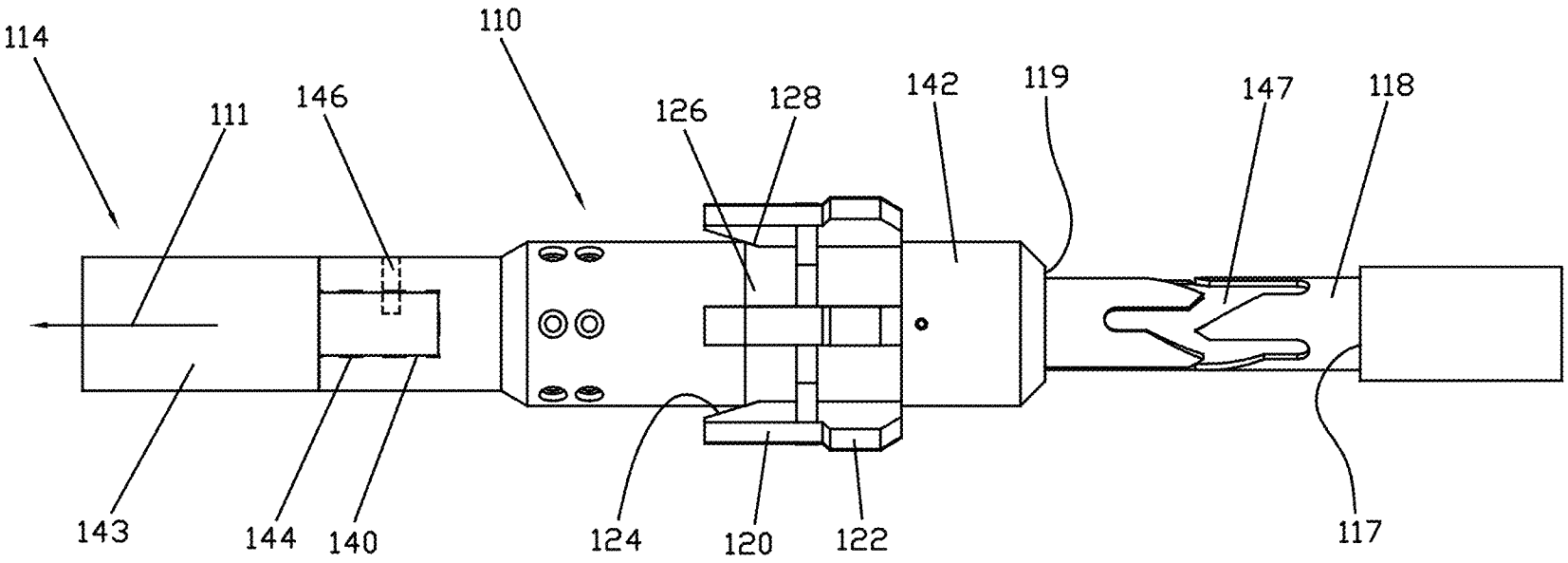
FIG. 7 is a side view of the dissolvable plug from FIG. 6 with the slips fully extended.

FIG. 7 shows the dissolvable plug from FIG. 6 after the slips 120 are fully extended. In order to fully extend the slips 120, the drag blocks 122 continue to resist downward movement within the wellbore or casing due to friction between the drag blocks 122 and the well bore wall or casing. The friction provides sufficient force provided that the dissolvable lock 116 is absent such that the slips 120, the drag blocks 122, and shroud 142 assembly continues to move on the mandrel 118. As the slips 120 move on the mandrel 118, eventually the slips 120 angled inner surface 124 contacts the cone's 126 outer angled surface 128. As the slips 120 continue upward on the cone 126 the slips 120 angled inner surface 124 and the cone 126 is outer angled surface 128 act together to force the slips radially outward. As the slips move further outward the drag blocks 122 are pressed further into the well bore wall or casing eventually reaching a point where the slips 120 are no longer able to move radially outward thereby locking the dissolvable plug 110 in place within the wellbore.

Figure 8:
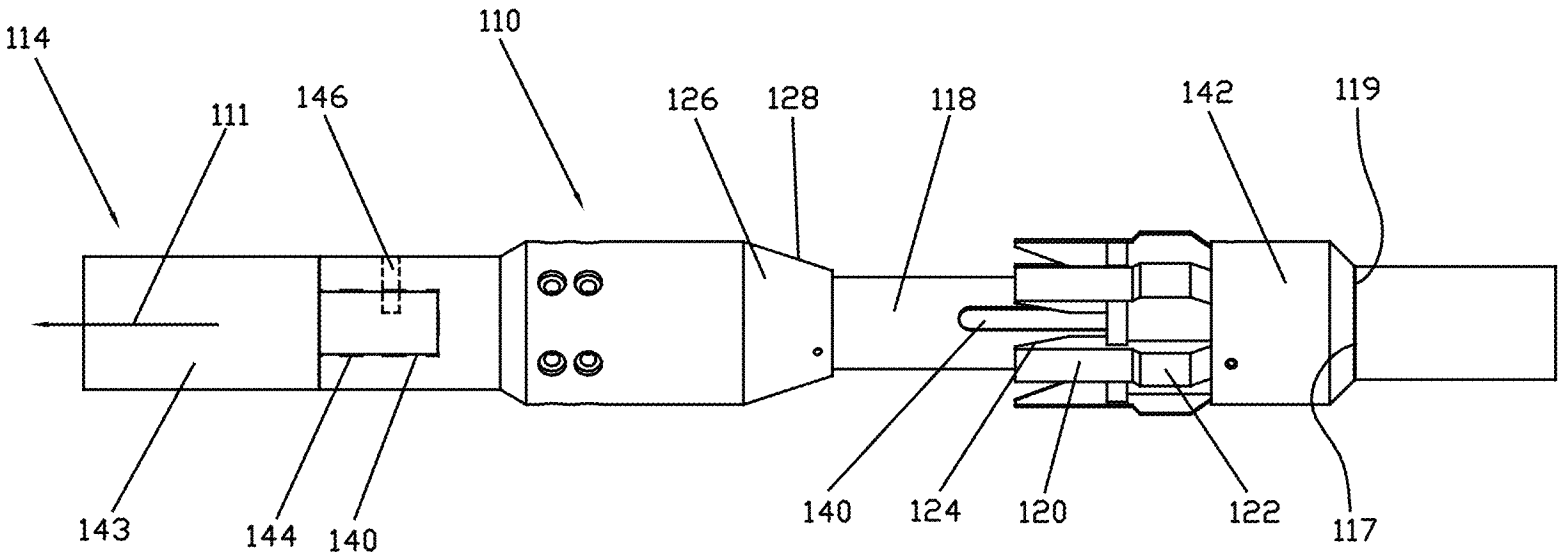
FIG. 8 is a side view of the dissolvable plug from FIG. 7 in a condition to allow the dissolvable plug's removal from the wellbore.

FIG. 8 shows the dissolvable plug from FIG. 7 in a condition to allow the dissolvable plug's 110 removal from the wellbore. An axial force is provided in the direction of arrow 111 on the upper end 114 of the dissolvable plug 110. The axial force in the direction of arrow 111 causes mandrel 118 as well as cone 126, which is rigidly attached to mandrel 118, to move in the upwards direction. Drag blocks 122 and slips 120 are locked within the wellbore and are thereby prevented from moving in the upwards direction with mandrel 118. As cone 126 is removed from supporting slips 120, the slips 120 and drag blocks 122 may now move radially inward. As the slips 120 and drag blocks 122 move radially inward they become detached from the wellbore or casing and no longer hold the dissolvable plug 110 in position within the wellbore or casing. As mandrel 118 continues to move upwards eventually mandrel shoulder 117 contacts shroud shoulder 119 preventing further downward movement of the shroud 142, drag blocks 122, and slips 120. As the axial force in the direction of arrow 111 continues, the entire dissolvable plug 110 and its various components may be removed from the well bore or casing.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A catching tool for a wellbore comprising:
a mandrel having a cone formed over a portion of the mandrel's length,
a series of slips arranged circumferentially about the mandrel,
a lock placed linearly between the cone and the slips,
wherein the lock prevents the slips from contacting the cone,
wherein the lock is dissolvable such that with the lock removed the slips contact the cone and are forced radially outwards thereby preventing further downward movement of the catching tool.

2. The catching tool of claim 1, wherein the lock is dissolvable magnesium.

3. The catching tool of claim 1, wherein the lock is dissolvable aluminum.

4. A catching tool for a wellbore comprising:
an electric submersible pump,
a catching tool placed below the electrical submersible pump,
the catching tool having a mandrel with a cone formed over a portion of the mandrel's length,
a series of slips arranged circumferentially about the mandrel,
a lock placed linearly between the cone and the slips,
wherein the lock prevents the slips from contacting the cone,
wherein the lock is dissolvable such that with the lock removed the slips contact the cone and are forced radially outwards thereby preventing further downward movement of the catching tool and the electrical submersible pump.

5. The catching tool of claim 4, wherein the lock is dissolvable magnesium.

6. The catching tool of claim 4, wherein the lock is dissolvable aluminum.

7. A catching tool for a wellbore comprising:
a mandrel having a cone formed over a portion of the mandrel's length,
wherein the mandrel includes a j-track
a set of slips arranged circumferentially about the mandrel,
wherein the slips include a shroud fixed to the slips,
a lock placed axially between the cone and the slips,
wherein the lock prevents the slips from contacting the cone,
wherein the lock is dissolvable,
the shroud interacts with the j-track to prevent the slips from contacting the cone,
wherein after the lock is dissolved and upon reaching a predetermined number of cycles the shroud allows the slips to contact the cone and are forced radially outwards thereby preventing downward further downward movement of the catching tool.

8. The catching tool of claim 7, wherein the lock is dissolvable magnesium.

9. The catching tool of claim 7, wherein the lock is dissolvable aluminum.

10. A method deploying an electrical submersible pump anchor comprising:
attaching a catching tool to an electrical submersible pump below the electrical submersible pump,
wherein the catching tool includes a mandrel having a cone formed over a portion of the mandrel's length,
a series of slips arranged circumferentially about the mandrel,
a lock placed linearly between the cone and the slips,
further wherein the lock prevents the slips from contacting the cone,
further wherein the lock is dissolvable,
running the catching tool and electrical submersible pump into a wellbore,
allowing the lock to dissolve such that with the lock removed the slips contact the cone and are forced radially outwards thereby preventing downward further downward movement of the catching tool and the electrical submersible pump.

11. The catching tool of claim 10, wherein the lock is dissolvable magnesium.

12. The catching tool of claim 10, wherein the lock is dissolvable aluminum.

* * * * *